United States Patent [19]

Elford

[11] 3,965,804

[45] June 29, 1976

[54] CONTAINER ERECTION APPARATUS

[76] Inventor: Peter Ellice Elford, 3 Wincroft Road, Caversham, Reading, Berkshire, England

[22] Filed: June 13, 1974

[21] Appl. No.: 479,053

[30] Foreign Application Priority Data

June 14, 1973 United Kingdom ..... 28384/73

[52] U.S. Cl. ..... 93/51 HW; 93/37 SP

[51] Int. Cl.[2] ..... B31B 1/46

[58] Field of Search ..... 93/51 HW, 51 R, 37 SP, 93/37 R, 37 EC, 47, 36 R, 49 R

[56] References Cited

UNITED STATES PATENTS

| | | | |
|---|---|---|---|
| 2,189,105 | 2/1940 | Evans et al. | 93/51 R |
| 2,848,926 | 8/1958 | Gschwind et al. | 93/51 HW |
| 2,921,506 | 1/1960 | Johnson | 93/51 HW |
| 3,359,873 | 12/1967 | Carle et al. | 93/37 SP |
| 3,416,653 | 12/1968 | Farquhar | 93/37 SP |
| 3,429,236 | 2/1969 | Randles, Jr. | 93/51 R |

*Primary Examiner*—James F. Coan

*Attorney, Agent, or Firm*—Hill, Gross, Simpson, Van Santen, Steadman, Chiara & Simpson

[57] ABSTRACT

Container erection apparatus is provided which automatically erects a blank of cardboard or the like to form a container which can be changed from a transit state to a display state, even when containing its intended contents, by folding two parts of the container about a crease, the folding crease in a surface (the folding surface) thereof which is planar while the container is in the transit state so that the parts of said surface on either side of the crease come together. The apparatus erects the blank in such a manner that it leaves the apparatus in the display state, entirely ready for filling in a later piece of apparatus or manually. To this end, the apparatus is arranged to cause the said parts of the folding surface to pivot towards one another about the folding crease in such a manner that the crease moves upwardly and that end surface portions of the blank move inwardly towards one another and remain substantially horizontal during such movement. The partly-erected blank is then moved downwardly through a die to erect edge parts of said end surface portions to form end tray parts of the container.

7 Claims, 8 Drawing Figures

CONTAINER ERECTION APPARATUS

This invention relates to apparatus for the erection of display containers or trays from blanks of corrugated cardboard, non-corrugated cardboard, paperboard, plastics board or other suitable sheet material. More particularly, the invention relates to apparatus for the erection of a display container or tray which can be changed from a transit state to a display state, even when containing its intended contents, by folding two parts of the container about a crease in a surface thereof which is planar whilst the container is in the transit state so that the parts of said surface on either side of the crease come together. The said crease and surface will be hereinafter respectively referred to as "the folding crease" and "the folding surface".

Exemplary trays of this form are shown in U.K. Registered Design Nos. 953,434, 955,102, 955,103 and 955,104 of Macmillan Bloedel Containers Limited.

Heretofore, these trays have been assembled by hand. It will be appreciated that in view of the very large numbers of these trays presently used in the packaging field, for example for packaging cylindrical, rectangular or otherwise-shaped packets of biscuits at the factory, hand assembly is very expensive and time-consuming. Accordingly, it is an object of the present invention to provide apparatus which will enable wholly or mainly automatic assembly of the trays or containers from the blanks and which, more particularly, erects the trays or containers in the display state so that they are completely ready for filling.

According to the present invention, there is provided apparatus for erecting a blank into a container, the blank comprising a central surface portion (the folding surface) having two like parts defined by a central crease (the folding crease) and two end surface portions each extending from a respective one of the said two parts of the folding surface and each defined along an edge meeting the associated said part by a second crease parallel to the folding crease, each of the end surface portions including edge parts defined by creases and which, when erected, cause the end portions to form end tray parts of the container, the apparatus comprising:

i. means for supporting the blank in a desired, substantially horizontal position;

ii. erection means for partly erecting the blank, said erection means being arranged to cause said two parts of the folding surface to pivot towards one another about the folding crease in such a manner that the folding crease moves upwardly and said end surface portions move towards one another and remain substantially horizontal as the folding crease moves upwardly;

iii. a die disposed below said desired position of the blank; and, iv. movement means for moving the partly erected blank downwardly through the die to a container discharge position to erect said edge parts of said end surface portions to form said end tray parts.

The container emerges from the apparatus in the display state entirely ready to be manually or automatically filled with the intended contents. The container can then be folded to the transit state ready for shipping, after which a shrink film wrapping may be applied.

To ensure that the partly-erected blank is passed properly down through the die, the apparatus may include means for holding said two parts of the folding surface together during movement of the partly erected blank downwardly through the die. The holding means may conveniently include an upwardly-opening slot arranged to enclose the folding crease and regions of said two parts of the folding surface adjacent the folding crease during downward movement of partly-erected blank, the width of the slot in the horizontal direction perpendicular to the folding crease being greater than twice the thickness of the blank.

In a preferred form of apparatus described in more detail below, the erection means comprises an elongate crease breaker disposed below said desired position of support of the blank and extending in a direction parallel with and below the folding crease, and means for moving the crease breaker upwardly. Such an arrangement has been found to be a particularly convenient way of carrying out the function of the erection means as specified above, though other means may be employed. Further, in this preferred form of the apparatus, the movement means comprises a forming head disposed above said desired position of support of the blank and having a recess defined in a lower surface thereof to accommodate the upward movement of the crease breaker and the folding crease, and means for moving the forming head downwardly. The above-mentioned holding means may be incorporated in the forming head, particularly by arranging for the above-mentioned slot to open upwardly from the centre of the top of the recess within the forming head. The folding crease and regions of the said two parts of the folding surface adjacent the crease are urged into the slot, either before the forming head is moved down or upon initial movement down.

The recess in the forming head is preferably terminated at its lower edges on either side of the folding crease with corners arranged to facilitate breaking of the second crease on upward movement of the folding crease. The corners, in co-operation with the surface on which the blank rests, also serve to constrain the end surface portions to move linearly inwardly. A prismatic recess has been found to be a very suitable form: in the case where the above-mentioned slot is provided, it opens upwardly from the apex of the prismatic recess.

The preferred apparatus includes a support disposed below said desired position of the blank and having a periphery small enough to go through the die, the support being movable down through the die with the forming head with the partly-erected blank sandwiched between the support and the forming head. This arrangement ensures that erection in the die takes place properly. Conveniently, the crease breaker and the means for moving the crease breaker are disposed within a well in the support.

In an embodiment of the invention described in more detail below, a pair of members are positioned on opposite edges of said desired position of the blank for engagement with free edges of said end surface portions parallel to the folding crease, and means is provided for moving said members inwardly to assist the operation of said erection means. This assistance for the erection means, e.g. for the crease breaker, has been found particularly desirable when the blank material is quite rigid, e.g. when the blank is of corrugated cardboard. In use, the crease breakers and the edge-engaging members are operated together, until the two parts of the folding surface are fairly close together. The crease breaker is then retracted to enable the parts to come fully together under the sole influence of the edge-engaging members. It should be carefully noted that the edge-engaging members supplement the operation of the crease-breaker and can be dispensed with in some cases, particularly if a blank material less rigid than corrugated cardboard is employed. In this case, of course, the crease breaker will not pivot the two parts of the folding surface fully together. However, if the above-mentioned slot arrangement is employed, the crease breaker will insert the crease inside or almost inside of the mouth of the slot and, when the forming head moves down, the slot will slide down over the parts of the folding surface adjacent the crease and urge them together.

The appartus may include a pair of erector members positioned on opposite sides of said desired position of the blank, one at each end of the folding crease, and means for moving said erector members upwardly from rest positions for erecting side parts of the blank extending from the sides of the folding surface. Advantageously, the erector members, in their rest positions, form parts of a pair of opposed walls of the die. A pair of retention plates may be disposed one above each of said erector members to retain said side parts erected upon partial completion of said upward movement of the folding crease. In this way, the erector members may be withdrawn as soon as the side parts are held in place by the retention plates. This feature is particularly advantageous when the members form parts of the die, since they are retracted into their die positions in good time before the forming head is passed down through the die.

The apparatus may include a pair of shafts disposed below the die and above said container discharge position, one shaft extending along each side of the discharge position, a respective pair of members attached to each shaft so that the members are clear of the downward path of movement of the partly-erected blank, and means for rotating the shafts whereby each of the members is rotated inwardly of the apparatus to the inside of a respective side edge part of one of the end surface portions of the container when the container is in the discharge position. When one type of blank is used, the shaft mounted members are used to position and lock in place a set of flaps to complete erection of the container. In this case, each shaft-mounted member, during said inward rotational movement, is arranged to rotate a locking flap extending from an outside edge of the associated side edge part inwardly through 180° and to urge a tongue on said flap into an aperture in the blank. When another type of blank, not provided with locking flaps, is used, the members provide pressure for quick setting of a cold or hot-melt adhesive used to complete erection and assembly of the container. In this case, the apparatus includes means for applying an adhesive to areas of those surfaces of said side edge parts which, when the blank is erected, are the inside surfaces of said parts, and is arranged so that each shaft-mounted member exerts pressure between a said area of a respective side edge part and another part of the blank in contact therewith. Each shaft-mounted member may be provided with removable projection means arranged to exert said pressure, whereby the same apparatus may be used with either type of tray.

The invention will be more readily understood from a consideration of the following description of the accompanying drawings, in which.

Figure 1:
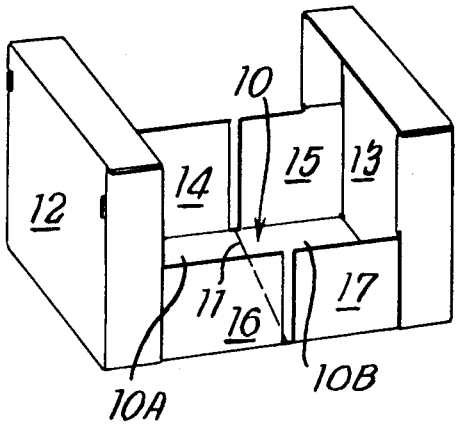
FIGS. 1 and 2 are perspective views of one form of display tray which may be erected by apparatus in accordance with the present invention, the views of FIGS. 1 and 2 showing the tray in the transit and display positions, respectively.

The display container shown in its transit state in FIG. 1 is formed from corrugated cardboard and comprises a base surface 10 (the folding surface) divided into two like parts 10A, 10B by a central folding crease 11. The container also comprises tray-like end sections 12, 13 and four side walls 14, 15, 16 and 17. The terms "side", "base" and "end" as used herein in describing the container and the blank from which it is formed refer to the orientation adopted by the parts they qualify in the transit state of the erected container.

Figure 2:
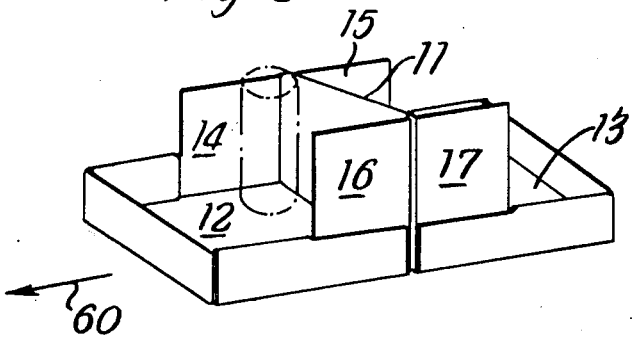

As can readily be seen, by pivoting the base parts 10A, 10B about the central crease 11 so that these two parts come together, the container can be made to adopt the display state shown in FIG. 2, the sections 12 and 13 then each acting as a tray with the two trays separated by a vertical wall formed by the adjacent base parts 10A, 10B.

The manner in which the container is used is as follows. In the factory, the container is caused to adopt the display state of FIG. 2, or possibly some state intermediate the transit and display states, and a respective array of articles, such as an array of cylindrical, rectangular or otherwise-shaped packets of biscuits, is inserted into the tray formed by each of the end sections 12, 13. One such article is shown in chain-dotted lines in FIG. 2. The container is then caused to adopt the transit state of FIG. 1, in which condition the two arrays of articles are held together, end-to-end. A shrink wrapping is then applied to the container to protect the contents and to keep the container in the transit condition.

When one wishes to display the contents of the container for sale, the shrink-wrapping is removed and the container is folded into the display condition shown in FIG. 2. As will be seen, the articles can be simply and readily inspected by customers while in the container and removed as desired from the container.

Figure 3:
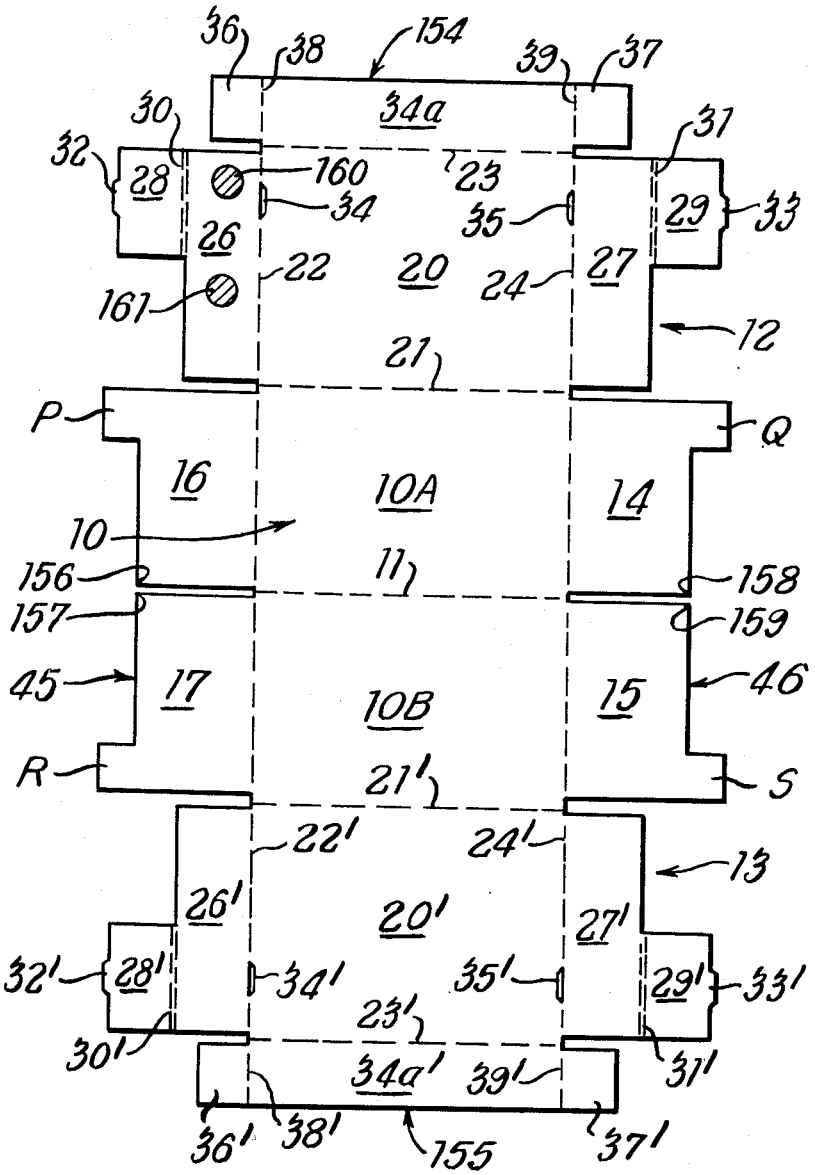
FIG. 3 is a plan view of a blank which may be erected into a display container like that shown in FIGS. 1 and 2.

A blank suitable for formation into the display container shown in FIGS. 1 and 2 is shown in FIG. 3. In FIG. 3, the dotted lines indicate creases or scores in the blank, which is made of corrugated cardboard. As mentioned before, blanks of the form shown in FIG. 3 have heretofore been manually assembled into containers of the form shown in FIGS. 1 and 2.

As previously mentioned, the blank shown in FIG. 3 comprises a base surface 10 (the folding surface) formed by two parts 10A, 10B defined by a folding crease 11. The above-mentioned side walls 14, 15, 16 and 17 are defined by the free edges of the blank and by respective creases joining them to the base 10, and each of the walls 14 to 16 is provided with a respective projecting flap P, Q, R and S.

The end section 12 comprises a main part 20 defined on one side by a crease 21 also defining one edge of the base surface 10. The other three sides of the part 20 are defined by three further creases 22, 23 and 24. The creases 22 and 24 also serve to define, respectively, edges of edge parts 26 and 27. Each edge part 26, 27 has a respective locking flap 28, 29 extending therefrom and defined at one edge by a double crease 30, 31. The creases 30, 31 are double creases to allow the locking flaps to be wrapped conveniently around two thicknesses of the blank material, as described below. If the blank is fabricated from a material somewhat thinner than corrugated cardboard, the creases 30, 31 may be single creases. The outer edge of each flap 28, 29 is provided with a respective locking tongue 32, 33. Apertures 34, 35 are provided in the main surface part 20, adjacent the creases 22, 24, for co-operation with the tongues 32, 33 in a manner to be described hereinbelow. As well as defining one edge of the main part 20 of the end section 12, the crease 23 also serves to define one edge of a further edge part 34*a*. At its ends, the part 34*a* has end flaps 36, 37 defined by respective creases 38, 39.

The end section 13 of the blank is of exactly the same construction as the end section 12 and so will not be described. Parts of the end section 13 are identified in FIG. 3 by the same reference numerals used to identify the corresponding parts of the end section 12, but have prime superscripts.

Figure 4:
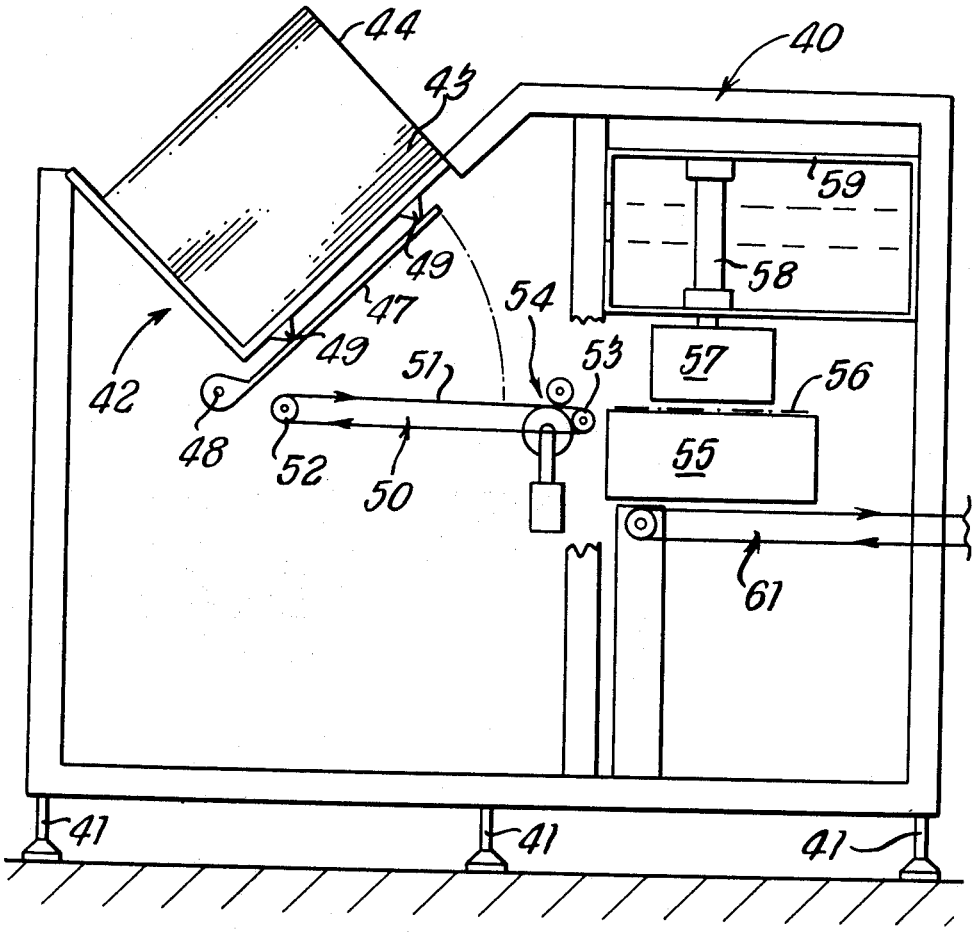
FIG. 4 is a somewhat schematic side view of apparatus suitable for erecting a blank of the form shown in FIG. 3 into a container of the form shown in FIGS. 1 and 2.

In FIG. 4 there is shown schematically a form of apparatus for erecting blanks of the type shown in FIG. 3 into containers of the form shown in FIGS. 1 and 2. The apparatus is mounted on a frame 40 which rests on feet 41. The apparatus includes an automatic blank feeder 42 mounting a stack 43 of blanks of the type shown in FIG. 3. The blanks are so disposed that the edges thereof corresponding to the end 44 of the stack are either one of the side edges 45, 46 of the blank as shown in FIG. 3. Suitable forms of blank feeder will be known to those skilled in the art and thus this part of the apparatus will not be described further, save to briefly explain that a frame 47 pivotally mounted at 48 and having a plurality of suction cups 49 thereon pivots upwardly and withdraws the lowest blank from the stack and then pivots downwardly, then releasing the blank.

The automatic blank feeder 42 is arranged to dispose blanks, one at a time, on to a conveyor 50 comprising a belt 51 entrained around two rollers 52, 53, at least one of which is driven. Printing means 54 is arranged at the discharge end of the conveyor 50 for applying a code marking to each blank as it is fed into the apparatus.

The conveyor 50 feeds each blank deposited thereon to a platform defined by the upper surface of a part of the apparatus shown at 55 in FIG. 4. The position of a blank when resting correctly on the platform is shown by a chain-dotted line 56 in FIG. 4. Suitable means (described hereinbelow) is provided to ensure correct location of the blank on the platform.

A forming head 57 is spaced above the part 55. A pneumatic ram 58 is fixed to a frame 59 which is in turn fixed to the frame 40 to cause downward movement of the forming head 57 and subsequent upward return movement. The downward movement of the forming head 57, coupled with other forming and subsequent operations fully described hereinbelow, erect each blank into a container adopting the display state as shown in FIG. 2. Each container is discharged from the apparatus part 55 in a direction which is out of the plane of FIG. 4, towards the viewer, and which is shown in FIG. 2 by the arrow 60. The container is discharged on to a dead plate (not shown in FIG. 4) and the next container discharged indexes the first-mentioned container off of the dead plate and on to an output conveyor 61.

Figure 5:
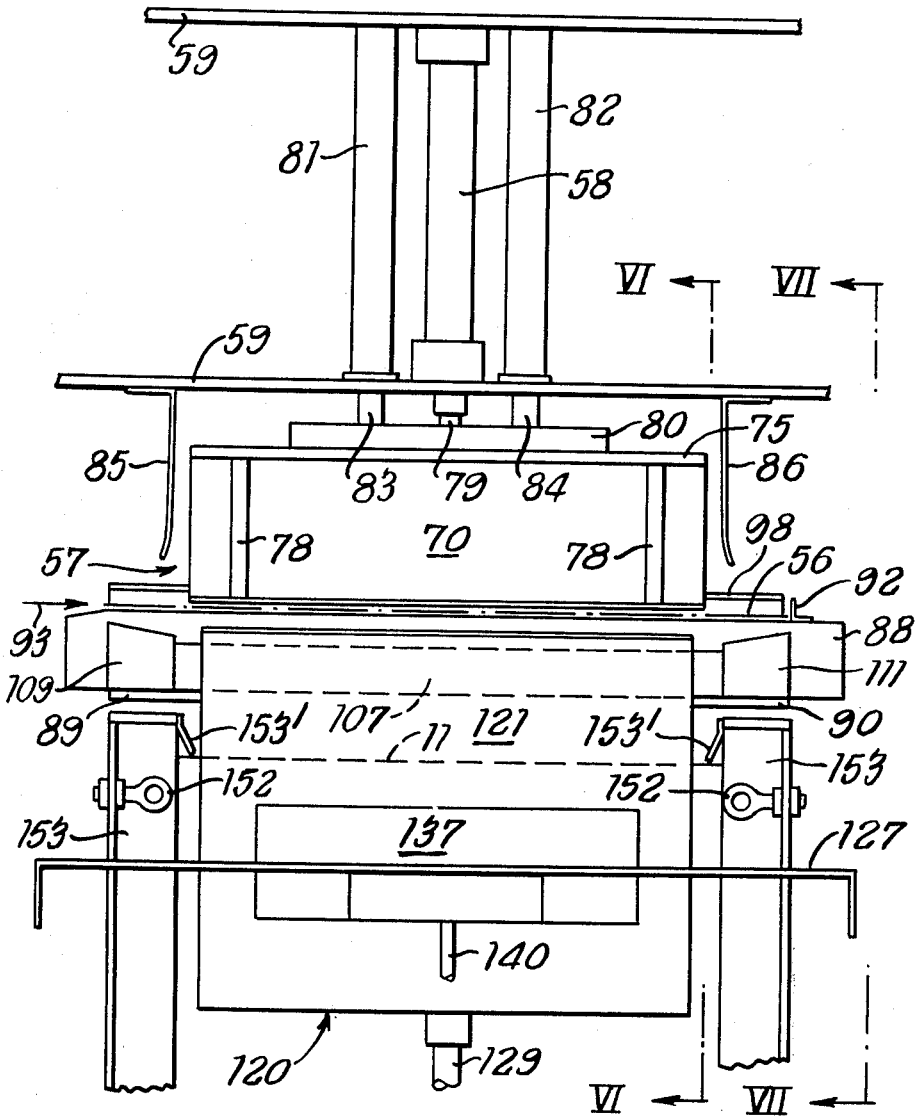
FIG. 5 is a side view on an enlarged scale of part of the apparatus shown in FIG. 4, certain parts being omitted for clarity of illustration.

The arrangement comprising the forming head 57 and the apparatus part 55 will now be described in more detail with reference to FIGS. 5, 6 and 7. In these three figures, like reference numerals indicate like parts. For clarity, each figure omits certain parts of the arrangement and the views should therefore be considered together and in conjunction with the following description in order to provide a clear understanding of the arrangement and of its manner of operation.

The forming head 57 comprises a plate 70 configured (FIG. 6) so that its lower surface 71 defines an upwardly tapering, prismatic recess having lower edges 72, 73. The apex of the recess terminates in a horizontally elongate slot 74 of width somewhat greater than twice the thickness of the blank. The plate 70 is held rigid by an upper plate 75 which is connected to horizontal lower edge parts 76, 77 of the plate 70 by a plurality of struts 78. The actuating rod 79 of a pneumatic ram 58 is connected to a bar 80 extending along and connected to the upper surface of the plate 75. Actuation of the ram 58 moves the forming head downwardly from the illustrated position.

Associated with the ram 58, in the case where the actuating rod 79 is circular in cross-section, is a guide arrangement comprising a pair of cylinders 81, 82 (FIG. 5) mounted on the frame 59. A pair of rods 83, 84 each connected at an end to the bar 80 slide within the cylinders during operation of the ram, to ensure that the forming head 57 moves in the intended manner. A like dual rod and cylinder arrangement can be associated with each of the other pneumatic rams to be described below, if the actuating rods thereof are circular in cross-section, but to clarify the description and drawings these arrangements will be neither illustrated nor described. It will be appreciated by those skilled in the container forming art that if the actuating rods are not circular in section, e.g. if they are rectangular, such guide arrangements are not needed.

Depending from and attached to the frame 59 are a pair of side wall retention plates 85, 86, one at each end of the prismatic recess defined by the plate 70 of the forming head 57. As can be seen from FIG. 5, the lower end of each plate is flared outwardly away from the forming head 57.

The part of the apparatus designated 55 in FIG. 4 will now be described. The part 55 includes a pair of box-section members 87, 88 which are mounted on a pair of plates 89, 90 in turn secured by means not shown to the frame 40. Each member 87, 88 has secured to it a respective abutment 91, 92. The abutments 91, 92 serve as stops to halt a blank in the correct position 56 when inserted in the direction of the arrow 93 in FIG. 5 by the input conveyor 50. In the position 56, the blank rests on the members 87, 88.

Each of the members 87, 88 has mounted thereon a respective pneumatic ram. The ram for the member 88 is shown in FIG. 6 at 94. A head 95 is attached to the end of the actuating rod 96 of the ram 94. Attached to the head 95 is a hook-like claw 97 which extends upwardly through an elongated recess in the upper web of the member 91. Actuation of the ram 94 moves the claw 97 to the left (as viewed in FIG. 6) from the position shown to a position short of the left-hand upright web of the member 88. A guide plate 98 (see also FIG. 5) is connected to the member 88 and extends inwardly over the path of travel of the claw 97. A like head, claw and guide plate are provided for the ram (not shown) for the member 87: the guide plate is shown at 99 in FIGS. 6 and 7.

Also mounted on the plates 89, 90 are an assembly of members which co-operate with a pair of vertically movable members 100, 101 to define a rectangular die of shape corresponding to the outline of the base of the carton when in the display state of FIG. 2. In other words, the die corresponds in shape to the areas 20 and 20' of the blank of FIG. 3 when the parts 10A and 10B have been folded together as will be explained below. One pair of opposed sides of the die are defined by four like members 102 to 105 and by the vertically movable members 100, 101. The other pair of opposed sides are defined by a pair of members 106, 107. Four members 108 to 111 are disposed one adjacent each corner of the die for a reason explained below.

Figures 6, 8:
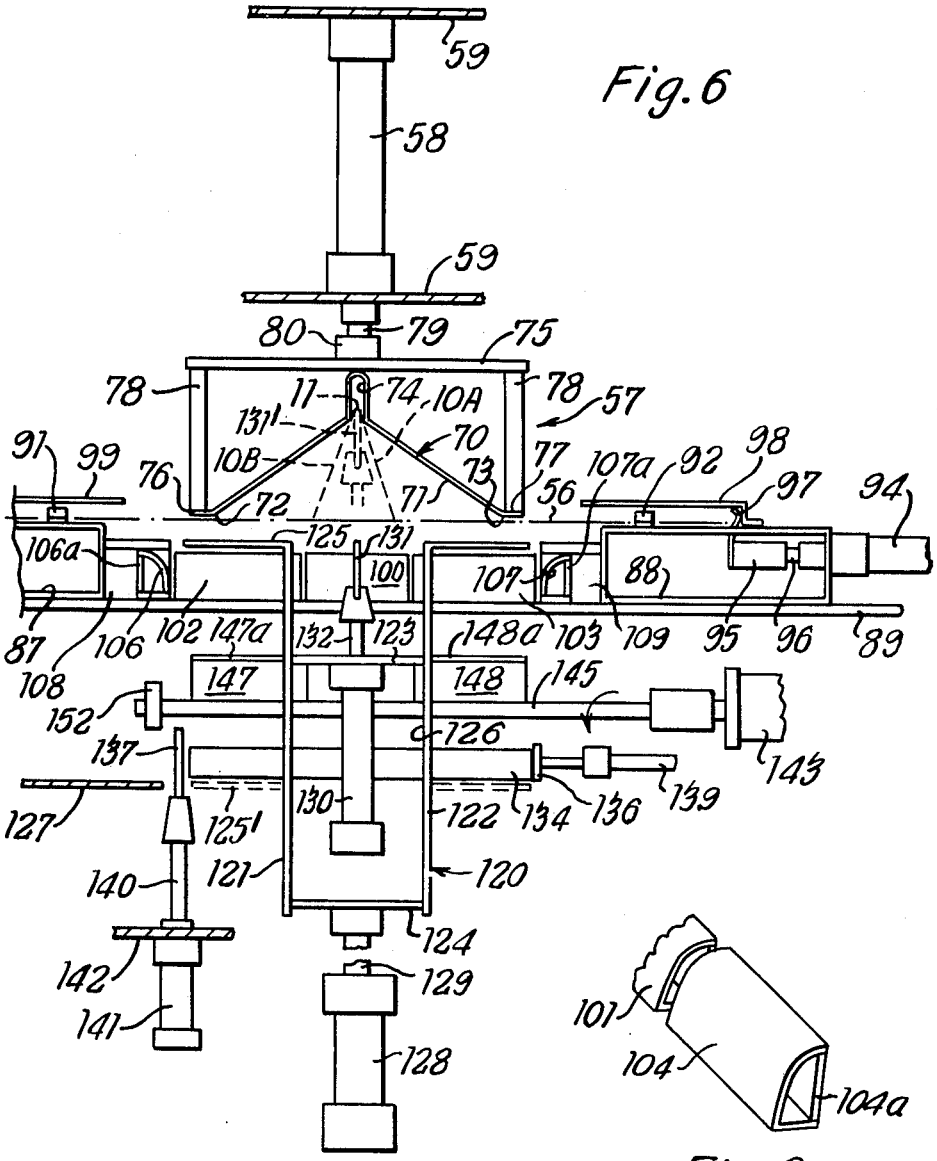
FIG. 6 is a sectional view of the part of the apparatus shown in FIG. 5, taken substantially along the line VI—VI of FIG. 5, certain parts being omitted for clarity of illustration.
FIG. 8 is a scrap perspective view from the inside of part of a die forming part of the apparatus; and, FIG. 9 is a sectional view of part of the apparatus taken along the line IX—IX in FIG. 7 and illustrating the construction of flap positioners forming part of the apparatus.

As can be seen from FIG. 8 and from the end views of members 106 and 107 in FIG. 6, each of the members 100 to 107 comprises a piece of plate configured to have a first flat lower surface portion and a second portion extending upwardly from the inner edge of the first portion. The second portion is curved to facilitate erection of the blank by the die. The first and second portions are braced together by struts, e.g. 104*a*, and 104*b*, 106*a* and 107*a*.

A vertically movable support 120 is mounted within the die as shown. The support 120 comprises a pair of inverted L-shaped plates 121, 122 braced together by members 123, 124 to define a horizontal platform 125 having a central well 126 therewithin. During operation of the machine, as is explained more fully below, the forming head 57 is moved downwardly by the ram 58 and pushes the support 120 down to a position where the platform 125 adopts the position shown in FIGS. 6 and 7, in dotted lines, at 125'. In such position, the upper surface of the platform is aligned with the upper surface of the dead plate mentioned in the foregoing description of FIG. 4 and shown in FIGS. 5, 6 and 7 at 127. A pneumatic ram 128 mounted to the frame 10 by means not shown has its operating rod 129 connected to the brace 124 of the support 120 to return the support to its upper position.

A further pneumatic ram 130 (FIG. 6) is mounted within the well 126 in the support 120 by connection to the brace 123. A plate-like central crease breaker 131 is connected to the free end of the operating rod 132 of the ram 130 so that, in the position shown in FIG. 6, its upper edge lies in or slightly below the plane of the upper surface of the platform 125. Actuation of the ram 130 causes the crease breaker 131 to move upwardly with respect to the support 120 to the position 131' shown in dotted lines in FIG. 6.

Figures 7, 9:
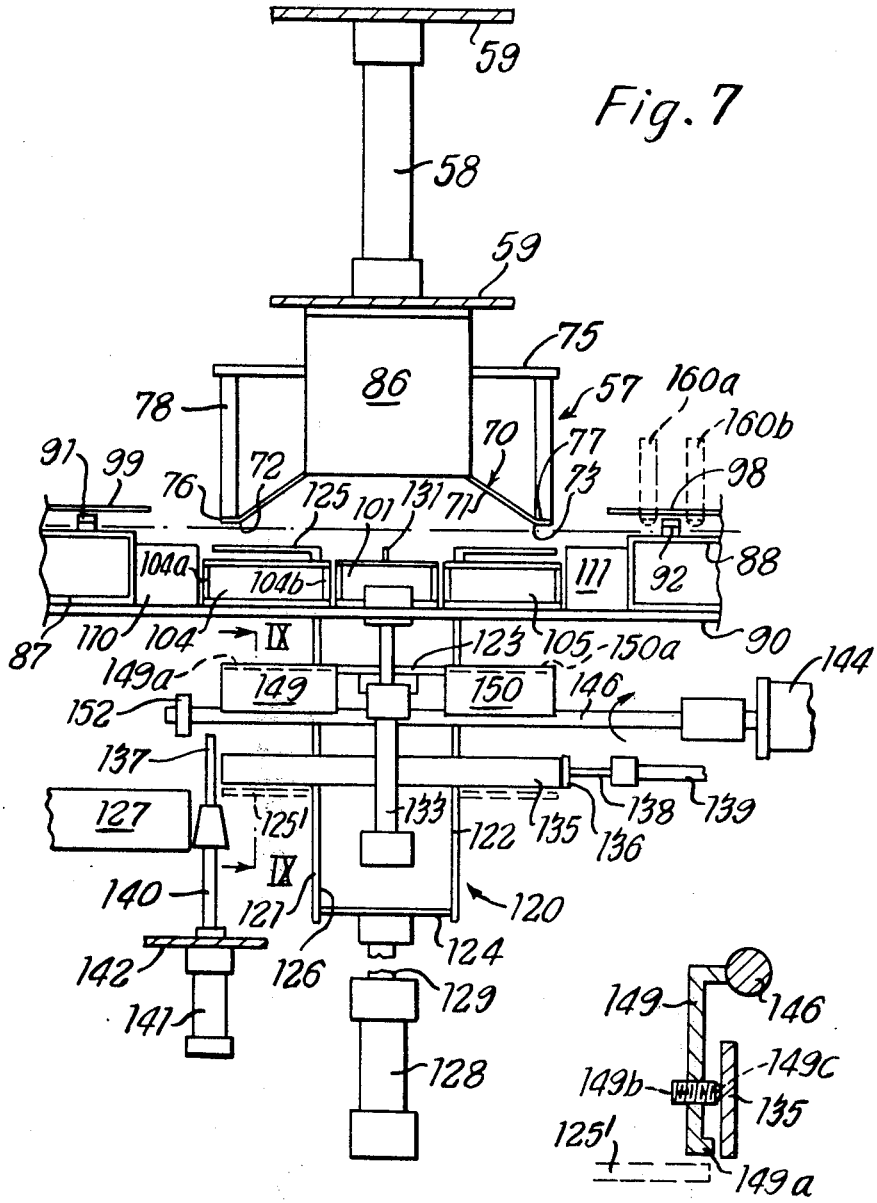
FIG. 7 is an end view of the part of the apparatus shown in FIGS. 5 and 6, taken substantially along the line VII—VII of FIG. 5, certain parts being omitted for clarity of illustration.

A respective ram is provided for moving each of the vertically movable die side members 100, 101 upwardly from the positions shown in FIGS. 6 and 7. The ram for the member 101 is shown at 133 in FIG. 7. The ram 133, and the corresponding ram (not shown) for the member 100, are mounted on the frame 40 by means not shown.

A pair of opposed plates 134, 135, a horizontally movable pusher 136 and a vertically movable release plate 137 serve to define a rectangular area substantially corresponding to that of the die at a position just above the lower position 125' of the platform 125. The plates 134, 135 are connected to the frame 40 by means not shown. The pusher 136 is connected to the operating rod 138 of a ram 139, secured to the frame 40 by means not shown, for movement to the left (as viewed in FIGS. 6 and 7) from the position shown to a position just short of the dead plate 127. The release plate 137 is connected to the operating rod 140 of a ram 141, mounted on a part 142 of the frame 10, for movement downwardly from the position shown to a position where its upper edge is aligned with or below the upper surface of the platform 125 when in the position 125'.

A pair of pneumatic torque units 143, 144 (FIGS. 6 and 7) are mounted on the frame 10 by means not shown. The units 143, 144 drive respective shafts 145, 146 on which are mounted four plate-like flap positioners 147 to 150 each provided with a nose (147*a* to 150*a*) at the end remote from the shaft. The torque units 147, 144 rotate the shafts 145, 146 inwardly towards the die, in the directions of the arrows shown in FIGS. 6 and 7, to rotate the flap positioners 147 to 150 inwardly through substantially 180°. The flap positioner 149 is shown in FIG. 9 in the position it adopts when it has been so rotated. At their ends remote from the torque units 143, 144, the shafts 145, 146 are journalled in eye bearings 152 carried by parts 153 of the frame 10.

Also mounted on frame parts 153 are a pair of resilient strips 153' (FIG. 5), the purpose of which is explained hereinbelow.

The manner of operation of the apparatus will now be described. Referring first to FIG. 4, the blank feeder 42 withdraws the lowermost blank from the stack 43 and deposits it on the conveyor 50. The conveyor 50 moves the deposited blank to the right (as viewed in FIG. 4) in the direction of the arrow 93 (FIG. 5) to the position 56. The blank is halted in the correct position by the abutments 91, 92. Erection of the blank then commences. As a first step, the members 100, 101 are moved upwardly to erect the side walls 14, 15, 16, 17. For the time being, the members 100 and 101 are maintained in their upper positions. The crease breaker 131, the upper edge of which is aligned with the central crease 11 of the blank, is then moved upwardly by the ram 130. The crease 11 is therefore broken and the parts 10A, 10B of the base or folding surface 10 of the blank pivot towards one another as shown in dotted lines in FIG. 6. The corners 72, 73 of the plate 70 act as fulcrums during this operation to assist breaking of the creases 21, 21′ as the parts 20, 20′ of the blank are drawn inwardly during pivoting together of the parts 10A, 10B, and ensure that the parts 20, 20′ move linearly inwardly rather than attempting to pivot with the parts 10A, 10B.

The claw 97 actuated by the ram 94 and the corresponding claw and ram (not shown) assist the erection step described immediately above. Substantially simultaneously with actuation of the ram 130, the ram 94 and the corresponding ram (not shown) are actuated so that the claws engage the edges 154, 155 (FIG. 3) of the blank so as to urge the parts 20, 20′ inwardly to facilitate pivoting together of the parts 10A, 10B and breaking of the creases 11, 21, 21′. The guide plates 98, 99 ensure that the parts 20, 20′ are guided correctly inwardly.

It will be appreciated that whilst the foregoing operation is proceeding, the corners 156 to 159 (FIG. 3) of the side walls 14 to 17 of the blank, which walls are being maintained vertical by the members 100, 101, will be raised, since the walls 14 to 17 are moving from positions corresponding to those they adopt in FIG. 1 to positions corresponding to those they adopt in FIG. 2. Thus, at an intermediate stage in the foregoing operation, the corners 156 to 159 will rise inside the side wall retention plates 85, 86. The flaring of the lower edges of these plates assists in guiding the side walls 14 to 17 inside the plates. As soon as this stage has been reached, the members 100, 101 are retracted to their illustrated positions, the side walls 14 to 17 being held in place by the plates 85, 86.

The operation of pivoting the parts 10A, 10B together continues till the crease breaker 131 reaches the position 131′ (FIG. 6). The crease breaker 131 is then withdrawn by the ram 130, since it would otherwise prevent the parts 10A, 10B from coming fully together. The operation is therefore completed solely by the claw 97 and ram 94 and by the corresponding claw and ram (not shown). When the parts 10A, 10B have been pivoted substantially through 90° so that they are in contact, the claws are withdrawn to their starting positions. During the final stage of this operation, the portions of the parts 10A, 10B adjacent the central crease 11 enter the slot 74 opening from the apex of the prismatic recess defined by the surface 71. The slot 74 thus holds the parts 10A, 10B together and prevents any substantial pivoting apart from the claws are withdrawn. Thus, in this position, the parts 10A, 10B of the blank are held pivoted together; the recesses 21, 21′ are close together; the outer edges of the horizontal lower edge parts 76, 77 of the plate 70 lie just inside the creases 23, 23′; and the side walls 14 to 17 are held erect by the retention plates 85, 86.

The ram 58 is then actuated to move the forming head and partly erected container downwardly through the die. After a slight downward movement, the blank and head contact the platform 125 of the support 120. The blank is thus sandwiched between the edge parts 76, 77 and the platform 125 and the support 120 moves down with the forming head 57. The next erection step then commences. First, the end flaps 36, 37, 36′, 37′ of the blank meet the parts 108 to 111, and are thereby pivoted upwardly by a certain amount about the creases 38, 39, 38′, 39′. The blank is then pushed downwardly through the die, so that the edge parts 34*a*, 34*a*′ are erected by the pair of opposed walls of the die defined by the plates 106, 107, and the edge parts 26, 27, 26′, 27′ (together with the flaps 28, 29, 28′, 29′) are erected by the pair of opposed walls of the die defined by the members 100 to 105. Due to the fact that the end flaps 36, 37, 36′, 37′ have been partially erected before entering the die proper, when the blank passes through the die these flaps are caused to pivot through 90° about the creases 38, 39, 38′, 39′ so that they lie inside the erected edge parts 26, 27, 26′ 27′. Thus, after passage through the die, the blank is erected to a stage corresponding to the display state shown in FIG. 2, save that the locking flaps 28, 29, 28′, 29′ have not yet been used to secure the ends of the container in place. These flaps are still planar with edge parts 26, 27, 26′, 27′, the creases 30, 31, 30′, 31′ being unbroken.

After passage through the die, the downward motion of the partly-formed container, the forming head 57 and the support 12 continues until the platform reaches the position 125′. In this position, the parts of the blank erected by the die are held erect by the fixed plates 134, 135, the pusher plate 136 and the release plate 137. The final erection step then takes place. The torque units 143, 144 are actuated whereby the flap positioners 147 to 150 are rotated inwardly through 180°. The flaps 28, 29, 28′, 29′ are thus rotated inwardly about the creases 30, 31, 30′, 31′ so that the tongues 32, 33, 32′, 33′ engage with and are locked in the apertures 34, 35, 34′, 35′, thereby entrapping the end flaps 36, 37, 36′, 37′ and the projecting portions P, Q, R, S inside the parts 26, 27, 26′, 27′ and under the flaps, and thus completing the erection of the container into the display state. The noses 147*a* to 150*a* on the flap positioners assist in urging the tongues 32, 33, 32′ 33′ into the apertures 34, 35, 34′, 35′. The torque units 143, 144 then return the flap positioners to the illustrated positions.

The release plate 137 is then downwardly retracted by actuation of the ram 141 and the container is pushed off of the platform 125 and on to the dead plate 127. The release plate 137 is then raised to the illustrated position by the ram 141. Subsequent containers discharged from the platform will index the container on to the output conveyor 61 (FIG. 4).

The ram 139 retracts the pusher plate 136 to the illustrated position and the rams 128 and 58 return the support 120 and the forming head 57, respectively, to their illustrated positions. The apparatus is then ready for the next operation. The forming head 57 is preferably retracted at the earliest possible moment, e.g. as soon as the partly-erected blank has been moved down to the support to the lower position and before the flap positioners are operated, so that erection of the next container can be commenced while the final steps of the erection of the preceding container are completed. In this way, the machine can function at the fastest possible speed.

The forming head 57 may, in some circumstances, tend to lift the blank up with it when it is retracted. The spring strips 153′ (FIG. 5) prevent this. When the blank is pushed down by the head 57, the strips 153′ are pushed out of the way by the blank as it moves past them. When, however, the blank reaches its lowest position, the strips 153′ spring outwardly over opposite ends of the folding crease 11, as shown in FIG. 5, to prevent the blank being thereafter lifted.

It will be apparent to one skilled in the art that control means will be required to actuate the various rams at the correct times; and that the control means may include interlocks to ensure that certain operations will only be initiated when and if certain other operations have been concluded or started. The provision of such control means and the arrangement thereof are within the routine knowledge of one skilled in the art and therefore need not be described.

The invention may be performed in other ways than that specifically described above. For instance, in some cases, particularly when the blank is of a less rigid material than corrugated cardboard, e.g. if it is of paperboard, the central crease breaker 131 will not require the assistance of the dual claw arrangement to pivot the parts 10A and 10B together. Thus, in this case, the claws and rams need not be provided. In this case, the central crease breaker 131 pivots the parts 10A and 10B into the positions shown in dotted lines in FIG. 6 and is then retracted. When the forming head 57 is then moved downwardly, the slot 74 moves with respect to the parts 10A and 10B and moves them together, into itself.

The apparatus described above, or rather a slightly modified form thereof, can be used to erect a container which is bascially the same as that shown in FIG. 3, but is modified in that the locking flaps 28, 29, 28′, 29′ are not provided. In this case, the apparatus may be provided with adhesive applicators arranged to apply an adhesive to the upper surfaces of each of the edge parts 26, 27, 26′, 27′ of the blank before these are erected. Adhesive may be applied to each such part in the areas thereof shown for part 26 in FIG. 3 at 160 and 161. The adhesive may be applied immediately after the blank enters, for example by downwardly movable ball applicators 160*a*, 160*b* shown in dotted outline in FIG. 7. As the blank is pushed down through the die, and considering now only the edge part 26, the edge flap 36 and projection P will be urged against the areas 160 and 161, respectively, and thus secured to the part 26. Although, in such a modification, the flap positioners 147 to 150 are redundant as flap positioners since there are no flaps, for the reason now to be explained it is advantageous to retain them. For various reasons, it is convenient to use either a hot-melt or a cold adhesive. These adhesives operate best when maximum pressure is applied to the joint, and in the case of cold adhesives of the PVA (polyvinyl acetate) type, unless a very high pressure is applied to the parts to be joined by the adhesive, setting takes a predetermined time (somewhere in the order of 5 to 10 seconds), which will slow down the operation of a packaging machine which is intended to function more quickly or require the additional expense and complexity of adding to the apparatus a compression and setting chamber. However, the present apparatus can function with both hot-melt and cold adhesive without any loss of speed if the flap positioners are retained, since these can be used firmly to press the end flaps 36, 37, 36′ and 37′ and the projections P, Q, R, S against the edge parts 26, 27, 26′, 27′, whereby the adhesive sets quickly and high speed operation can be maintained. To this end, projections may be fitted to the flap positioners in line with the adhesive spots. The projections are preferably removable so that the same apparatus can be used with either locking or glueing type of blank. One form of removable projection is shown in dotted outline in FIG. 9. The projection comprises a threaded shank 149*b* screwed into a threaded aperture in the positioner 149 and having a ball-shaped head 149*c* for applying pressure to the glue joint, i.e. to a position on the outside of either the flap P or the flap 36 overlying the areas of the edge part to which adhesive is applied at areas 160, 161.

The apparatus described above can be modified by, in effect, rotating the forming head 57 the support 120 and certain other parts through 90° about a vertical axis, so that the blank is entered in the direction of the longer of its two major dimensions (between the edges 154 and 155) rather than in the direction of the shorter of its two major dimensions (between the edges 45 and 46). Either arrangement works as well as the other. However, for the following reason, the illustrated arrangement is preferred. Critical path analysis shows that entry of the blank from the input conveyor 50 is on the critical path and should therefore be effected as quickly as possible. Since, for a given speed, entry is effected more quickly if the blank enters in the shorter rather than in the longer of its two major dimensions, the illustrated arrangement enables a higher speed of operation than the alternative arrangement.

Various other modifications can be made to the apparatus described without departing from the scope of the present invention. For instance, the input conveyor 50 can be replaced by a pneumatic ram and pusher arrangement. Alternatively, the input conveyor 50 and the blank feeder 42 can be dispensed with altogether, the blanks being fed manually into the position 56.

In place of certain of the pneumatic rams illustrated, twin rams arrangements mounted in tandem may be employed, i.e. arrangements in which one ram is moved by the operating rod of a second ram, so that when the rams are simultaneously operated the controlled member moves at twice the speed and over twice the stroke. Such arrangements are particularly desirable when the movement is on the critical path, in which case high speed is required, and/or when a long stroke is required.

The torque units 143, 144 may, of course, be replaced by a single torque unit coupled to the shafts 145, 146 by appropriate gearing.

It is also within the scope of the invention to use other movement means than penumatic rams and pneumatic torque units to perform the various movement functions. For example, hydraulic rams, electrical actuators, mechanical drive means or any other suitable form of mechanism may be used.

As will be evident from the foregoing disclosure, the present invention provides an important contribution to the packaging art. It enables the hitherto expensive and time consuming operation of manually erecting display containers or trays of the type described to be carried out automatically and in a way in which they leave the apparatus in the display state, completely ready to be filled.

I claim:

1. Apparatus for erecting a blank into a container, said blank comprising a folding surface portion having two like parts defined by a folding crease and two end surface portions each connected to a respective one of the said two parts of the folding surface at a second crease parallel to the folding crease, each of the end surface portions including edge parts connected at creases and which, when erected, cause the end portions to form end tray parts of the container, said apparatus comprising:

a. means for supporting the blank in a desired, substantially horizontal position;

b. erection means for causing the two parts of the folding surface to pivot towards one another about the folding crease as the end surface portions remain substantially horizontal, said erection means having an elongated crease breaker disposed below the desired position of support of the blank and extending in a direction parallel with and below the folding crease, and means for moving said crease breaker upwardly;

c. a die disposed below said desired position of the blank; and d. movement means for moving the partly erected blank downwardly through said die to a container discharge position to erect said edge parts of said end surface portions to form said end tray parts, said movement means having a forming head disposed above said desired position of support of the blank and having a recess defined in a lower surface thereof to accommodate the upward movement of said crease breaker and the folding crease, said recess in the forming head being terminated at its lower edges on either side of the folding crease with corners adapted to facilitate breaking of said second creases on upward movement of the folding crease, and means for moving said forming head downwardly.

2. Apparatus according to claim 1 including a pair of shafts below said die and above said container discharge position, one shaft extending along each side of said discharge position, a respective pair of members attached to each shaft so that the members are clear of the downward path of movement of the partly erected blank, a nose on each of said shafts, and means for rotating said shafts whereby each of said shaft-mounted members is rotated inwardly of the apparatus to the inside of a respective side edge part of one of said end surface portions of the container.

3. Apparatus for erecting a blank into a container, said blank comprising a folding surface portion having two like parts defined by a folding crease and two end surface portions each connected to a respective one of the said two parts of the folding surface at a second crease parallel to the folding crease, each of the end surface portions including edge parts connected at creases and which, when erected, cause the end portions to form end tray parts of the container, said apparatus comprising:

a. means for supporting the blank in a desired, substantially horizontal position;

b. erection means for causing the two parts of the folding surface to pivot towards one another about the folding crease as the end surface portions remain substantially horizontal, said erection means having an elongated crease breaker disposed below the desired position of support of the blank and extending in a direction parallel with and below the folding crease, and means for moving said crease breaker upwardly;

c. a die disposed below said desired position of the blank; and d. movement means for moving the partly erected blank downwardly through said die to a container discharge position to erect said edge parts of said end surface portions to form said end tray parts, said movement means having a forming head disposed above said desired position of support of the blank and having a recess defined in a lower surface thereof to accommodate the upward movement of said crease breaker and the folding crease, said recess in the forming head being terminated at its lower edges on either side of the folding crease with corners adapted to facilitate breaking of said second creases on upward movement of the folding crease, and means for moving said forming head downwardly.

4. Apparatus for erecting a blank into a container, said blank comprising a folding surface portion having two like parts defined by a folding crease and two end surface portions each connected to a respective one of the said two parts of the folding surface at a second crease parallel to the folding crease, each of the end surface portions including edge parts connected at creases and which, when erected, cause the end portions to form end tray parts of the container, said apparatus comprising:

a. means for supporting the blank in a desired, substantially horizontal position;

b. erection means for causing the two parts of the folding surface to pivot towards one another about the folding crease as the end surface portions remain substantially horizontal, said erection means having an elongated crease breaker disposed below the desired position of support of the blank and extending in a direction parallel with and below the folding crease, and means for moving said crease breaker upwardly;

c. a die disposed below said desired position of the blank; and d. movement means for moving the partly erected blank downwardly through said die to a container discharge position to erect said edge parts of said end surface portions to form said end tray parts, said movement means having a forming head disposed above said desired position of support of the blank and having a recess defined in a lower surface thereof to accommodate the upward movement of said crease breaker and the folding crease, said recess defined within said forming head being substantially prismatic, and means for moving said forming head downwardly.

5. Apparatus for erecting a blank into a container, said blank comprising a folding surface portion having two like parts defined by a folding crease and two end surface portions each connected to a respective one of the said two parts of the folding surface at a second crease parallel to the folding crease, each of the end surface portions including edge parts connected at creases and which, when erected, cause the end portions to form end tray parts of the container, said apparatus comprising:

a. means for supporting the blank in a desired, substantially horizontal position;

b. erection means for causing the two parts of the folding surface to pivot towards one another about the folding crease as the end surface portions remain substantially horizontal, said erection means having an elongated crease breaker disposed below the desired position of support of the blank and extending in a direction parallel with and below the folding crease, and means for moving said crease breaker upwardly;

c. a die disposed below said desired position of the blank;

d. movement means for moving the partly erected blank downwardly through said die to a container discharge position to erect said edge parts of said end surface portions to form said end tray parts, said movement means having a forming head disposed above said desired position of support of the blank and having a recess defined in a lower surface thereof to accommodate the upward movement of said crease breaker and the folding crease, and means for moving said forming head downwardly; and e. support means disposed below said desired position of the blank and having a periphery small enough to go through said die, said support means being movable down through said die with said forming head with the partly-erected blank sandwiched between the support means and the forming head, a well being defined in said support means for containing said crease breaker and said means for moving the crease breaker.

6. Apparatus for erecting a blank into a container, said blank comprising a folding surface portion having two like parts defined by a folding crease and two end surface portions each connected to a respective one of the said two parts of the folding surface at a second crease parallel to the folding crease, each of the end surface portions including edge parts connected at creases and which, when erected, cause the end portions to form end tray parts of the container, said apparatus comprising:

a. means for supporting the blank in a desired, substantially horizontal position;

b. erection means for causing the two parts of the folding surface to pivot towards one another about the folding crease as the end surface portions remain substantially horizontal, said erection means having an elongated crease breaker disposed below the desired position of support of the blank and extending in a direction parallel with and below the folding crease, and means for moving said crease breaker upwardly;

c. a die disposed below said desired position of the blank;

d. movement means of moving the partly erected blank downwardly through said die to a container discharge position to erect said edge parts of said end surface portions to form said end tray parts, said movement means having a forming head disposed above said desired position of support of the blank and having a recess defined in a lower surface thereof to accommodate the upward movement of said crease breaker and the folding crease, and means for moving said forming head downwardly; and e. a pair of erector members positioned on opposite sides of said desired position of the blank, one at each end of the folding crease, means for moving said erector members upwardly from rest positions for erecting side parts of the blank extending from the sides of the folding surface, and said erector members, in their rest positions, forming parts of a pair of opposed walls of said die.

7. Apparatus for erecting a blank into a container, said blank comprising a folding surface portion having two like parts defined by a folding crease and two end surface portions each connected to a respective one of the said two parts of the folding surface at a second crease parallel to the folding crease, each of the end surface portions including edge parts connected at creases and which, when erected, cause the end portions to form end tray parts of the container, said apparatus comprising:

a. means for supporting the blank in a desired, substantially horizontal position;

b. erection means for causing the two parts of the folding surface to pivot towards one another about the folding crease as the end surface portions remain substantially horizontal, said erection means having an elongated crease breaker disposed below the desired position of support of the blank and extending in a direction parallel with and below the folding crease, and means for moving said crease breaker upwardly;

c. a die disposed below said desired position of the blank;

d. movement means for moving the partly erected blank downwardly through said die to a container discharge position to erect said edge parts of said end surface portions to form said end tray parts, said movement means having a forming head disposed above said desired position of support of the blank and having a recess defined in a lower surface thereof to accommodate the upward movement of said crease breaker and the folding crease, and means for moving said forming head downwardly;

e. a pair of erector members positioned on opposite sides of said desired position of the blank, one at each end of the folding crease, means for moving said erector members upwardly from rest positions for erecting side parts of the blank extending from the sides of the folding surface, said erector members, in their rest positions, forming parts of a pair of opposed walls of said die; and f. a pair of retention plates disposed one above each of said erector members to retain said side parts erected upon partial completion of said upward movement of the folding crease.

* * * * *